US006890085B2

(12) United States Patent
Hacker

(10) Patent No.: US 6,890,085 B2
(45) Date of Patent: May 10, 2005

(54) LED MODULE

(75) Inventor: Christian Hacker, Regensburg (DE)

(73) Assignee: Osram Opto Semiconductors GmbH, Regensburg (DE)

( * ) Notice: Subject to any disclaimer, the term of this patent is extended or adjusted under 35 U.S.C. 154(b) by 0 days.

(21) Appl. No.: 10/412,847

(22) Filed: Apr. 14, 2003

(65) Prior Publication Data

US 2003/0214817 A1 Nov. 20, 2003

(30) Foreign Application Priority Data

Apr. 12, 2002 (DE) ..... 102 16 394

(51) Int. Cl.[7] ..... F21V 9/00
(52) U.S. Cl. ..... 362/231; 362/236; 362/800
(58) Field of Search ..... 362/231, 236, 362/293, 545, 800

(56) References Cited

U.S. PATENT DOCUMENTS 5,803,579 A 9/1998 Turnbull et al.
5,851,063 A 12/1998 Doughty et al.
6,234,645 B1 5/2001 Börner et al.

FOREIGN PATENT DOCUMENTS

| | | |
|---|---|---|
| DE | 198 45 229 | 1/1998 |
| DE | 199 31 689 | 1/2001 |
| DE | 200 15 120 | 1/2001 |
| DE | 201 04 704 | 6/2001 |
| JP | 2001184910 | 6/2001 |
| WO | WO 01/41215 | 6/2001 |

*Primary Examiner*—John Anthony Ward
(74) *Attorney, Agent, or Firm*—Cohen, Pontani, Lieberman & Pavane

(57) ABSTRACT

LED module for generating white light having a plurality of white-light LEDs including at least one LED with a central wavelength of between 495 nm and 507 nm, at least one LED with a central wavelength of between 511 nm and 529 nm, at least one LED with a central wavelength of between 586 nm and 602 nm, and at least one LED with a central wavelength of between 618 nm and 630 nm.

8 Claims, 1 Drawing Sheet

LED MODULE

FIELD OF THE INVENTION

The invention relates to an LED module for generating white light and, in particular, to a white color that creats an impression that is as true to life as possible.

BACKGROUND OF THE INVENTION

A plurality of white-light LEDs are often used for LED modules of the type mentioned. A white light LED module can be defined as generating light that is composed of different colors that are especially selected so that, when they are blended together, the result is percieved as white light. These LEDs generally contain an LED chip, which emits short-wave, for example violet, blue or blue-green, light, and a conversion element, for example a luminescent material. The conversion element converts part of the light emitted by the LED chip into light having a longer wavelength, thus giving rise to the impression of white light. Perhaps the most efficient and commonly used white-light LED has blue-emitting GaN-based LED chips and a conversion element which emits in the yellow-orange spectral region are usually used.

Due to the above-described type of light generation, LED modules constructed with these white-light LEDs have a spectrum with a strong blue and yellow-orange component. As regards other colors, the spectrum has distinct gaps, particularly in comparison with other conventional white-light sources, such as incandescent lamps. This can impair the color impression made by the LED module. Furthermore, many applications provide for conventional white-light sources, such as incandescent lamps, to be replaced by LED modules, in which case the radiation spectrum is intended to be as similar as possible or the exchange is intended to be inconspicuous to the observer. Also, a white color impression that is as true to life as possible is often desirable for aesthetic reasons.

SUMMARY OF THE INVENTION

One object of the invention is to provide an LED module with a spectrum that is better approximated to the spectrum of a Planckian radiator.

This and other objects are achieved in accordance with one aspect of the invention directed to an LED module for generating white light, which comprises a plurality of white-light LEDs, at least one color LED with a central wavelength of between 495 nm and 507 nm, at least one LED with a central wavelength of between 511 nm and 529 nm, at least one LED with a central wavelength of between 586 nm and 602 nm, and at least one LED with a central wavelength of between 618 nm and 630 nm.

The invention is based on the concept of supplementing the missing spectral components in conventional LED modules by virtue of the LED module having color LEDs in addition to the white-light LEDs.

A distinctly improved color impression is thus achieved compared with conventional LED modules. In particular, the spectrum corresponds significantly better to a Planckian radiator of a given color temperature. A further advantage of the invention is that said color temperature can be changed by changing the brightness of the white-light and the color LEDs relative to each other.

In the case of the invention, the central wavelength is to be understood as the maximum of the intensity spectrum of the respective LEDs.

The following convention is used below, for simplification, for the designation of the color LEDs:

Type A: central wavelength between 495 nm and 507 nm,
Type B: central wavelength between 511 nm and 529 nm,
Type C: central wavelength between 586 nm and 602 nm,
Type D: central wavelength between 618 nm and 630 nm.

An LED module preferably contains $2n$ LEDs of type A, $2n$ LEDs of type B, n LEDs of type C, n LEDs of type D and $10n$ white-light LEDs. In this case, n designates a natural number, which particularly preferably assumes values of between 1 and 4.

In one advantageous refinement of the invention, the central wavelength for LEDs of type A is 501 nm, for LEDs of type B 520 nm, for LEDs of type C 594 nm and for LEDs of type D 624 nm.

In a further advantageous refinement of the invention, the spectral full width at half maximum (FWHM) for LEDs of type A is about 30 nm, for LEDs of type B about 33 nm, for LEDs of type C about 15 nm and for LEDs of type D about 18 nm.

Although the invention is particularly useful to fill the gaps of missing colors in the most commonly used type of white-light LED described above, the invention is advantageous for other types of white light LEDs because they usually show similar spectra with gaps.

Further features, advantages and expediencies of the invention emerge from the following explanation of an exemplary embodiment of the invention in conjunction with FIGS. 1 and 2.

DETAILED DESCRIPTION OF THE DRAWINGS

In both exemplary embodiments, the LED module comprises a total of 16 LEDs, composed of ten white-light LEDs, two LEDs of type A with a central wavelength of 501 nm, two LEDs of type B with a central wavelength of 520 nm, one LED of type C with a central wavelength of 594 nm and one LED of type D with a central wavelength of 624 nm.

The LEDs used are preferably LEDs from the company Osram Opto Semiconductors GmbH. In this case, LEDs bearing the designation LV E673 are suitable for LEDs of type A, LEDs bearing the designation LT E673 are suitable for LEDs of type B, LEDs bearing the designation LY E675 are suitable for LEDs of type C, and LEDs bearing the designation LA E675 are suitable for LEDs of type D. LEDs bearing the designation LW E67C, for example, can be used as the white-light LEDs.

Figure 1:
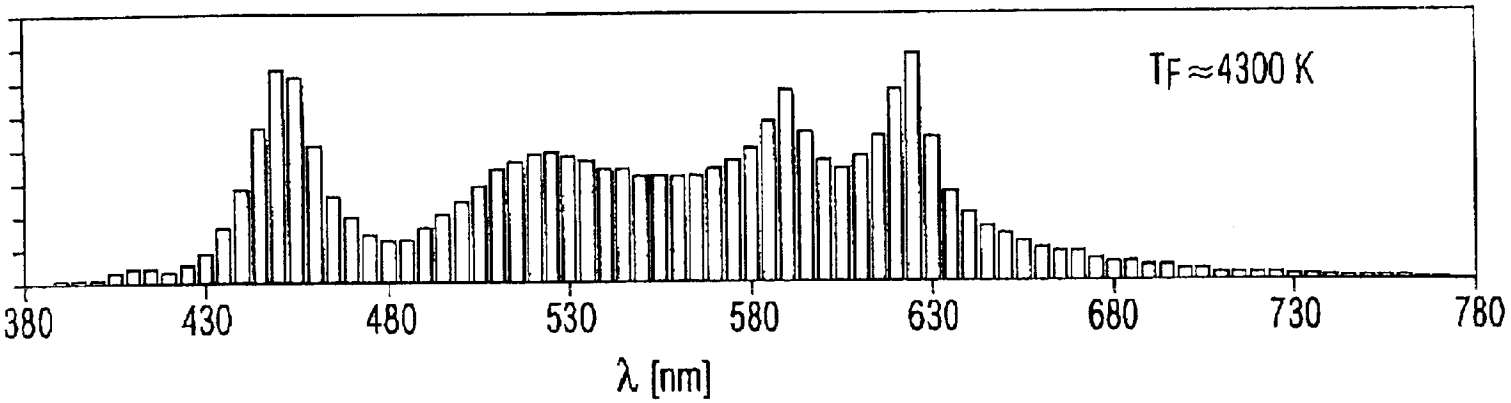
FIG. 1 shows a spectrum of a first exemplary embodiment of an LED module according to the invention.

FIG. 1 illustrates a simulated spectrum of this LED module. This spectrum corresponds significantly better to a Planckian radiator than the corresponding spectrum of an LED module without color LEDs. The LED module can be assigned a color temperature $T_F$ of about 4300 K.

The meaning of the term Planckian radiator is well known to one with ordinary skill in the art. As explained in the Dictionary of Exact Science and Technology by A. Kuncera, this refers to an ideal radiator also known as a black body radiator or a full radiator.

Figure 2:
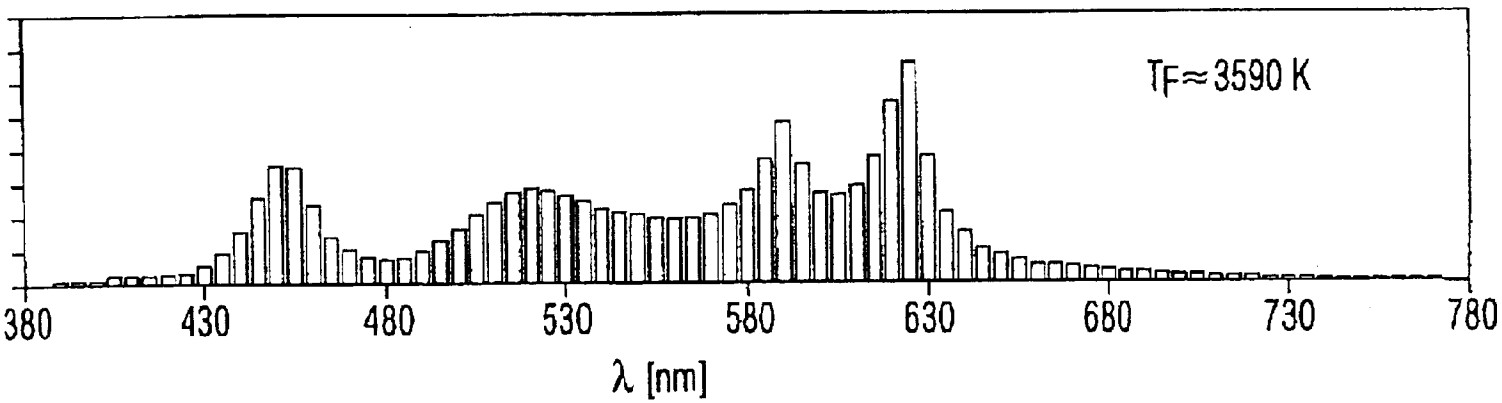
FIG. 2 shows a spectrum of a second exemplary embodiment of an LED module according to the invention.

In the case of the LED module illustrated in FIG. 2, the brightness of the white-light LEDs was reduced by 50% compared with the previous exemplary embodiment. The color temperature $T_F$ thus decreases to about 3590 K. The luminous efficiency is about 7.5 lumen per watt in both cases. The average color rendition $R_a$ of the LED module, with a value of 92, is very good and comes very near to the optimum value of 100, which applies to an incandescent lamp, for example. It is also possible to change the color temperature by changing the brightness of the color LEDs. For example, a decrease in the brightness of the color LEDs would result in an increased blue (and yellow) part of the emission spectrum and an increased color temperature.

More widely, in the context of the invention, it is possible to form multiple LED modules which comprise a plurality of modules according to the invention. By way of example, four of the above-described LED modules each having 16 LEDs can be joined together to form a multiple LED module having 64 LEDs. In addition to the greater total luminous flux, such a multiple LED module is distinguished by the fact that it can be divided into smaller units again, as required, and can thus be used flexibly.

It should be noted that white light in the context of the invention is not only purely white light with the color locus x=⅓, y=⅓, but also light which, deviating from this, is perceived as substantially white or whitish. In case of doubt, the definition of the color "white" used for the specification of vehicle lamps as set forth by the Economic Commission for Europe (ECE) can be consulted for this.

The scope of protection of the invention is not limited to the examples given hereinabove. The invention is embodied in each novel characteristic and each combination of characteristics, which includes every combination of any features which are stated in the claims, even if this combination of features is not explicitly stated in the claims.

I claim:

1. An LED module for generating white light, comprising:

a plurality of white-light LEDs, at least one color LED with a central wavelength of between 495 nm and 507 nm, at least one color LED with a central wavelength of between 511 nm and 529 nm, at least one color LED with a central wavelength of between 586 nm and 602 nm, and at least one color LED with a central wavelength of between 618 nm and 630 nm, wherein the the white-light LEDs generate white light of a first spectrum and the LED module generates white light of a second spectrum by combining light emitted by the white-light LEDs with light emitted by the color LEDs, the first spectrum of white light being different from the second spectrum of white light.

2. The LED module as claimed in claim 1, wherein the module comprises:

2*n* LEDs with a central wavelength of between 495 nm and 507 nm,

2*n* LEDs with a central wavelength of between 511 nm and 529 nm, n LEDs with a central wavelength of between 586 nm and 602 nm, n LEDs with a central wavelength of between 618 nm and 630 nm, and 10*n* white-light LEDs, where n is a natural number.

3. The LED module as claimed in claim 1, wherein brightness can be varied at least in the case of some of the color LEDs and/or the white-light LEDs relative to each other.

4. A multiple LED module comprising at least two LED modules as claimed in claim 1.

5. The LED module as claimed in claim 2, wherein the brightness can be varied at least in the case of some of the color LEDs and/or the white-light LEDs relative to each other.

6. A multiple LED module comprising at least two LED modules as claimed in claim 2.

7. The LED module as claimed in claim 2, wherein n is one of the numbers 1, 2, 3 and 4.

8. The LED module as claimed in claim 1, wherein the second spectrum of white light has a color temperature that can be varied by a variation of a brightness of the white light LEDs with respect to the brightness of the color LEDs.

* * * * *